US008938174B2

(12) United States Patent
Hirata et al.

(10) Patent No.: US 8,938,174 B2
(45) Date of Patent: Jan. 20, 2015

(54) IMAGE FORMING APPARATUS AND IMAGE FORMING METHOD

(71) Applicant: Konica Minolta, Inc., Chiyoda-ku, Tokyo (JP)

(72) Inventors: Katsuyuki Hirata, Toyokawa (JP); Takashi Harashima, Sagamihara (JP)

(73) Assignee: Konica Minolta, Inc. (JP)

( * ) Notice: Subject to any disclaimer, the term of this patent is extended or adjusted under 35 U.S.C. 154(b) by 0 days.

(21) Appl. No.: 14/052,961

(22) Filed: Oct. 14, 2013

(65) Prior Publication Data

US 2014/0112675 A1 Apr. 24, 2014

(30) Foreign Application Priority Data

Oct. 24, 2012 (JP) ..... 2012-234978

(51) Int. Cl.
*G03G 15/00* (2006.01)

(52) U.S. Cl.
CPC ..... *G03G 15/5062* (2013.01)
USPC ..... 399/49; 399/72

(58) Field of Classification Search
CPC ..... G03G 15/5062; G03G 15/5058
USPC ..... 399/49, 72, 15; 347/131
See application file for complete search history.

(56) References Cited

U.S. PATENT DOCUMENTS

| | | | | |
|---|---|---|---|---|
| 4,377,338 | A * | 3/1983 | Ernst | 399/49 |
| 7,526,241 | B2 * | 4/2009 | Kinoshita | 399/49 |
| 7,547,903 | B2 * | 6/2009 | Mizes et al. | |
| 2006/0018674 | A1 | 1/2006 | Hirata et al. | |
| 2007/0236747 | A1 * | 10/2007 | Paul | |
| 2009/0092408 | A1 * | 4/2009 | Mizes et al. | 399/49 |
| 2011/0063697 | A1 | 3/2011 | Shibuya | |

FOREIGN PATENT DOCUMENTS

| | | | |
|---|---|---|---|
| JP | 2006039036 | A | 2/2006 |
| JP | 2011087285 | A | 4/2011 |
| JP | 2011193132 | A | 9/2011 |

* cited by examiner

*Primary Examiner* — Susan Lee
(74) *Attorney, Agent, or Firm* — Cantor Colburn LLP

(57) ABSTRACT

An image forming apparatus includes: a detection unit detecting information about an image-adjusting pattern image fixed to a paper; a determination unit which, on the basis of an image-noise detecting pattern image that is formed on the paper prior to forming the image-adjusting pattern image, determines the presence or absence of an image noise generated in the image-adjusting pattern image; and a control unit. On the basis of the determination result of the determination unit, the control unit sets a detection region where the detection unit detects information about the image-adjusting pattern image, to a region where the image noise is not generated, and determines the image forming condition by using the information detected in the detection region.

12 Claims, 13 Drawing Sheets

IMAGE FORMING APPARATUS AND IMAGE FORMING METHOD

CROSS REFERENCES TO RELATED APPLICATIONS

The present invention contains subject matter related to Japanese Patent Applications JP 2012-234978, filed in the Japanese Patent Office on Oct. 24, 2012, respectively, the entire contents of which being incorporated herein by reference.

BACKGROUND OF THE INVENTION

1. Field of the Invention

The present invention relates to an image forming apparatus and an image forming method, and in particular relates to an electrophotographic image forming apparatus and an electrophotographic image forming method.

2. Description of the Related Art

In an electrophotographic image forming apparatus, an image is formed using static electricity and thus the image density, line width, and print position of an image fluctuate due to a fluctuation in environmental conditions such as temperature and humidity, in the use environment of the apparatus, and due to a temporal degradation of a photoreceptor, a developer or the like, that is, due to the changes in durability, and thus a stable image formation cannot be carried out.

In order to prevent this problem, a control (hereinafter, referred to as "image stabilization control") is carried out, in which the information about environmental conditions, the information about durability, and the information about an image-adjusting pattern image are detected and fed back to conditions for forming an image (hereinafter, referred to as "image forming conditions"), thereby stabilizing the image to be formed (e.g., see Patent Literature 1). Here, the "image-adjusting pattern image" is a pattern image exclusively formed for adjusting an image. By carrying out this image stabilization control, an image can be stably formed even if there are factors destabilizing the image formation.

As the above-described image stabilization control, generally two methods are known. One of them is a method (hereinafter, referred to as an "image stabilization control method (1)"), in which by means of a toner density sensor installed on an opposing portion of an intermediate transfer belt, there is detected the toner density of an unfixed image-adjusting pattern image formed on the intermediate transfer belt. The other one is a method (hereinafter, referred to as an "image stabilization control method (2)"), in which by means of a toner density sensor installed in a paper transport section after a fixing unit, the toner density of an image-adjusting pattern image fixed to a paper is detected.

For a relatively inexpensive image forming apparatus, the image stabilization control method (1) is often adopted. However, in the case of the stabilization control method (1), since the toner density sensor is installed downstream of a secondary transfer unit so as to face an intermediate transfer belt, it is not possible to detect fluctuations generated in the secondary transfer unit or in the fixing unit and to feedback the same to an image forming condition. Because these fluctuations are controlled by prediction, the stabilization control method (1) has a disadvantage of lacking the stability of image quality.

In contrast, a relatively expensive image forming apparatus, the image stabilization control method (2) has been adopted in recent years. In the case of the image-stabilization-control method (2), since the fluctuations generated in the secondary transfer unit or in the fixing unit, which cannot be detected by the image stabilization control method (1), can be also detected and fed back to an image forming condition, a further increase in image quality can be achieved as compared with the image stabilization control method (1).

Patent Literature 1: Japanese Patent Laid-Open No. 2006-39036

SUMMARY OF THE INVENTION

However, even with the image stabilization control method (2), when there is an image noise, such as an unexpected scratch or streak in a fixed image-adjusting pattern image, a detection result of the toner density sensor is fed back to the image forming condition under the influence of the image noise, and thus an output image (image to be formed) is adversely affected. In other words, the presence of an image noise in the fixed image-adjusting pattern image does not allow the information about the image-adjusting pattern image to be accurately reflected on the image forming condition.

An object of the present invention is to provide an image forming apparatus which, even under the conditions where an image noise such as a scratch or a streak is generated, can accurately reflect the information about an image-adjusting pattern image on an image forming condition, without being affected by the image noise.

In order to accomplish the above-described purpose, an image forming apparatus of the present invention is an image forming apparatus that determines an image forming condition by using an image-adjusting pattern image, the apparatus including: a detection unit detecting information about the image-adjusting pattern image fixed to a paper; a determination unit which, on the basis of an image-noise detecting pattern image that is formed on the paper prior to forming the image-adjusting pattern image, determines the presence or absence of an image noise generated in the image-adjusting pattern image; and a control unit which, on the basis of a determination result of the determination unit, sets a detection region where the detection unit detects information about the image-adjusting pattern image, to a region where the image noise is not generated, and which further determines the image forming condition by using the information detected in the detection region.

Moreover, in order to accomplish the above-described purpose, an image forming method of the present invention is an image forming method of determining an image forming condition by using an image-adjusting pattern image, the method including: a determination step of determining, on the basis of an image-noise detecting pattern image formed in a paper, the presence or absence of an image noise generated in the image-adjusting pattern image; a region setting step of setting, on the basis of a determination result of the determination step, a region where the image noise is not generated, as a detection region where information about the image-adjusting pattern image is detected; a detection step of detecting information about the image-adjusting pattern image fixed to the detection region on the paper; and a condition determination step of determining the image forming condition by using the information detected in the detection step.

DESCRIPTION OF THE PREFERRED EMBODIMENTS

Figure 1:
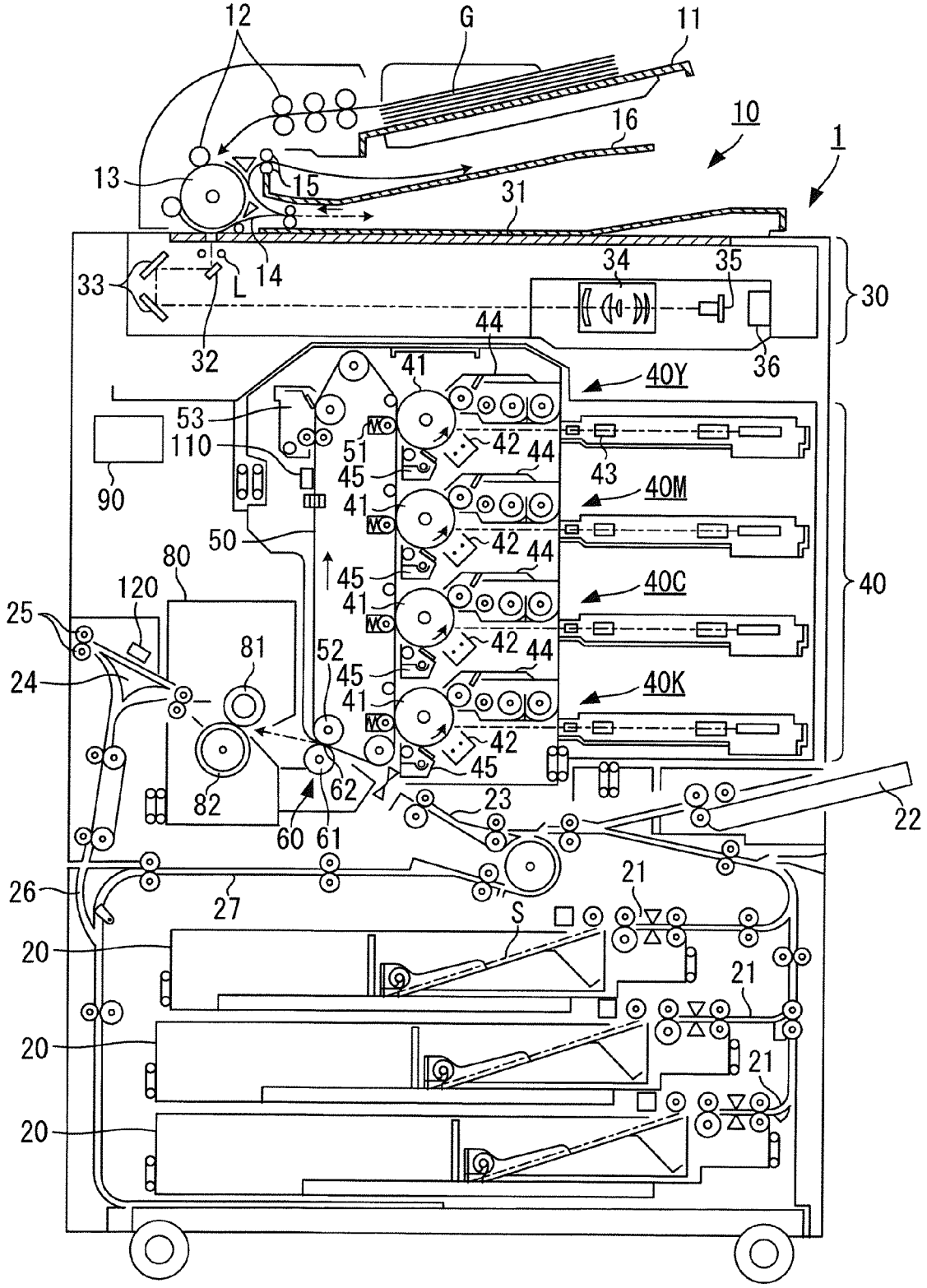
FIG. 1 is a whole configuration diagram showing an outline of the system configuration of an image forming apparatus according to an embodiment of the present invention.

Hereinafter, an embodiment of the present invention will be described in detail using the accompanying drawings. Note that, in the following description and each figure, the same reference numeral is attached to the same elements or elements having the same function and the duplicate description is omitted.

Configuration Example of Image Forming Apparatus

FIG. 1 is a whole configuration diagram showing an outline of the system configuration of an image forming apparatus according to an embodiment of the present invention. In the present embodiment, a case where the present invention is applied to a copying machine is taken as an example.

As shown in FIG. 1, the image forming apparatus 1 according to the present embodiment adopts an electrophotographic system that forms an image using static electricity, and is a tandem-type color image forming apparatus that superimposes four color toners of yellow (Y), magenta (M), cyan (C), and black (K). The image forming apparatus 1 includes a document transport section 10, a paper storage unit 20, an image reading unit 30, an image forming unit 40, an intermediate transfer belt 50, a secondary transfer unit 60, a fixing unit 80, and a control board 90.

The document transport section 10 includes a document feed stand 11 for setting a document, a plurality of rollers 12, a transport drum 13, a transport guide 14, a document discharge roller 15, and a document discharge tray 16. A document G set in the document feed stand 11 is transported one-by-one to a read position of the image reading unit 30 by the plurality of rollers 12 and the transport drum 13. The transport guide 14 and the document discharge roller 15 discharge the document G transported by the plurality of rollers 12 and the transport drums 13, to the document discharge tray 16.

The image reading unit 30 reads an image of the document G transported by the document transport section 10 or an image of a document placed on a document stand 31, and generates image data. Specifically, the image of the document G is irradiated by a lamp L. Reflected light from the document G based on irradiation light from the lamp L is directed to a first mirror unit 32, a second mirror unit 33, and a lens unit 34 in this order, and focused onto an acceptance surface of an image sensor 35. The image sensor 35 photoelectrically converts incident light and outputs a predetermined image signal. The output image signal is A/D-converted and created as image data.

In addition, the image reading unit 30 has an image reading control unit 36. The image reading control unit 36 subjects the image data created by A/D-conversion, to well-known image processing such as shading correction, dithering, and compression, and stores the resulting data into a RAM (not shown) mounted on the control board 90. Note that the image data is not limited to the data output from the image reading unit 30, and may be data received from an external apparatus such as a personal computer or other image forming apparatus, connected to the image forming apparatus 1.

The paper storage unit 20 is arranged under an apparatus main body, and a plurality of paper storage units 20 is provided depending on the size or type of a paper S. The paper S is fed by the paper feed unit 21 and sent to a transport section 23, and transported by the transport section 23 to the secondary transfer unit 60 that is at a transfer position. Moreover, in a vicinity of the paper storage unit 20, there is provided a manual paper feed unit 22. From the manual paper feed unit 22, special papers to be set by a user, such as a paper having a size not stored in the paper storage unit 20, a tag paper with a tag, and an OHP sheet are sent to the transfer position.

Between the image reading unit 30 and the paper storage unit 20, there are arranged the image forming unit 40 and the intermediate transfer belt 50. The image forming unit 40 has four image forming unit 40Y, 40M, 40C, and 40K in order to form a toner image of each color of yellow (Y), magenta (M), cyan (C), and black (K).

A first image forming unit 40Y forms a toner image of yellow, and a second image forming unit 40M forms a toner image of magenta. Furthermore, a third image forming unit 40C forms a toner image of cyan, and a fourth image forming unit 40K forms a toner image of black. Each of these four image forming units 40Y, 40M, 40C, and 40K each has the same configuration. Accordingly, here, the first image forming unit 40Y will be described.

The first image forming unit 40Y has a drum-shaped photoreceptor 41, a charging part 42 arranged around the photoreceptor 41, an exposure part 43, a development part 44, and a cleaning part 45. The photoreceptor 41 rotates under driving of a non-illustrated drive motor. The charging part 42 uniformly charges the surface of the photoreceptor 41 by applying charges to the photoreceptor 41. The exposure part 43 forms an electrostatic latent image on the photoreceptor 41 by exposing the surface of the photoreceptor 41 on the basis of image data read from the document G or image data transmitted from an external apparatus.

The development part 44 develops the electrostatic latent image formed on the photoreceptor 41, by using two-component developer including a toner and a carrier. The toner is a particle for forming an image. The carrier has a function to apply an appropriate charge to the toner by frictional electrification in mixing with the toner inside the development part 44, a function to transport the toner to a development region facing the photoreceptor 41, and a function to form a development field so that the electrostatic latent image on the photoreceptor 41 can be faithfully developed with the toner. The development part 44 causes a yellow toner to adhere to the electrostatic latent image formed on the photoreceptor 41. Thus, a toner image of yellow is formed on the surface of the photoreceptor 41.

Note that the development part 44 of the second image forming unit 40M causes a magenta toner to adhere to the photoreceptor 41, and the development part 44 of the third image forming unit 40C causes a cyan toner to adhere to the photoreceptor 41. Then, the development part 44 of the fourth image forming unit 40K causes a black toner to adhere to the photoreceptor 41.

The cleaning part 45 removes the toners remaining on the surface of the photoreceptor 41.

The toner adhering onto the photoreceptor 41 is transferred to the intermediate transfer belt 50 that is an example of an intermediate transfer body. The intermediate transfer belt 50 is endlessly formed and is bridged over a plurality of rollers. The intermediate transfer belt 50 rotates in a direction opposite to the rotational (moving) direction of the photoreceptor 41 under the drive by a non-illustrated drive motor.

At a position facing the photoreceptor 41 of each of the image forming units 40Y, 40M, 40C, and 40K in the intermediate transfer belt 50, there is provided a primary transfer unit 51. The primary transfer unit 51 transfers the toners adhering onto the photoreceptor 41 to the intermediate transfer belt 50 by applying, to the intermediate transfer belt 50, a voltage having the opposite polarity of the toner.

Then, by rotation of the intermediate transfer belt 50, the toner images formed by four image forming units 40Y, 40M, 40C, and 40K are sequentially transferred to the surface of the intermediate transfer belt 50. Therefore, on the intermediate transfer belt 50, toner images of yellow, magenta, cyan, and black overlap with each other to thereby form a color image.

Moreover, a belt cleaning device 53 faces the intermediate transfer belt 50. The belt cleaning device 53 cleans the surface of the intermediate transfer belt 50 having completed the transfer of the toner image to the paper S.

In a vicinity of the intermediate transfer belt 50 and downstream in the paper transport direction of the transport section 23, there is arranged the secondary transfer unit 60. The secondary transfer unit 60 transfers, to the paper S, a toner image formed on the outer circumferential surface of the intermediate transfer belt 50, by bringing the paper S which is transported by the transport section 23, into contact with the intermediate transfer belt 50.

The secondary transfer unit 60 includes a secondary transfer roller 61. The secondary transfer roller 61 is pressed against an opposing roller 52. In addition, a part where the secondary transfer roller 61 and the intermediate transfer belt 50 come in contact with each other, serves as a secondary transfer nip part 62. The position of the secondary transfer nip part 62 is a transfer position where a toner image formed on the outer circumferential surface of the intermediate transfer belt 50 is transferred to the paper S.

On the discharge side of the paper S in the secondary transfer unit 60, there is provided the fixing unit 80. The fixing unit 80 fixes the transferred toner image to the paper S by pressurizing and heating the paper S. The fixing unit 80 is constituted by, for example, a fixing upper roller 81 and a fixing lower roller 82 which are a pair of fixing members. The fixing upper roller 81 and the fixing lower roller 82 are arranged in a state of being pressed against each other, and a fixing nip part is formed as a pressure contact part between the fixing upper roller 81 and the fixing lower roller 82.

A heater is provided inside the fixing upper roller 81. A roller part of the fixing upper roller 81 is warmed by radiant heat from this heater. Then, the toner image on the paper S is fixed by the heat of the roller part of the fixing upper roller 81 being transmitted to the paper S.

The paper S is transported so that a surface thereof (surface to be subjected to fixing), to which a toner image is transferred by the secondary transfer unit 60, faces the fixing upper roller 81, and the paper S passes through the fixing nip part. Accordingly, pressurization by the fixing upper roller 81 and the fixing lower roller 82 and heating by heat of the the roller part of the fixing upper roller 81 are carried out on the paper S passing through the fixing nip part.

Downstream in the transport direction of the paper S of the fixing unit 80, there is arranged a switching gate 24. The switching gate 24 switches a transport path of the paper S having passed through the fixing unit 80. That is, the switching gate 24 causes the paper S to go straight, when face-up discharge is carried out in image formation onto one side of the paper S. Therefore, the paper S is discharged by a pair of paper discharge roller 25. Furthermore, the switching gate 24 guides the paper S downward, when face-down discharge in image formation onto one side of the paper S is carried out and also when image formation onto both sides of the paper S is carried out.

In carrying out face-down discharge, the paper S is guided downward by the switching gate 24 and then the front and back sides of the paper S are inverted and transported upward by a paper reversing/transporting part 26. Thus, the paper S, the front and back sides of which are inverted, is discharged by the pair of paper discharge roller 25. In carrying out image formation onto both sides of the paper S, the paper S is guided downward by the switching gate 24, and then the front and back sides of the paper S are inverted by the paper reversing/transporting part 26. Then, the paper S, the front and back sides of which are inverted, is again fed to the transfer position through a paper re-feed path 27.

On a downstream side of the pair of paper discharge roller 25, there may be arranged an aftertreatment device that folds the paper S or performs a stapling process and the like on the paper S.

[Image Stabilization Control]

In the above-described electrophotographic image forming apparatus 1, image stabilization control that adjusts the image forming condition is performed so that the density of an image (output image) to be formed becomes a target density. The examples of image forming condition can include an electrification voltage, an exposure amount, a development bias voltage, and the like. This image stabilization control is performed by forming an image-adjusting pattern image onto an image carrier of the intermediate transfer belt 50 and the like or onto a record medium such as the paper S, and detecting the density of this formed image-adjusting pattern image with the detection unit, and feeding back this detection result to the image forming condition and reflecting the same on the image forming condition.

The image-adjusting pattern image is formed, for example, onto an image carrier of the intermediate transfer belt 50 and the like or onto a record medium such as the paper S, as a patchy toner pattern image (hereinafter, referred to as a "toner patch image"). Here, there is described a case where a toner patch image is recorded on the paper S. The toner patch image includes patch columns of four colors of yellow (Y), magenta (M), cyan (C), and black (K), corresponding to the color of a toner image.

Figure 2:
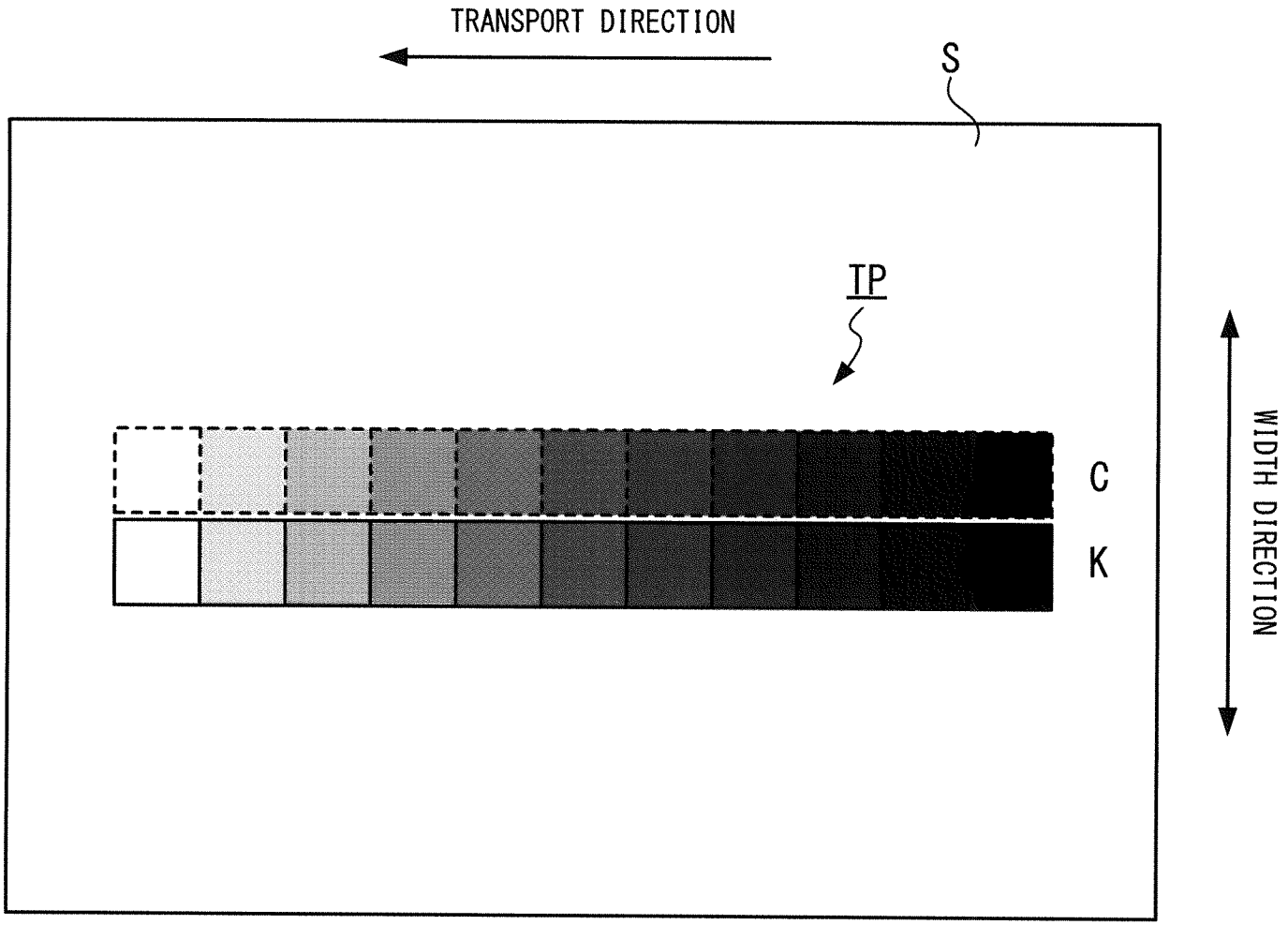
FIG. 2 is a view showing a toner patch image that is an example of an image-adjusting pattern image.

More specifically, as shown in FIG. 2, a toner patch image TP includes a plurality of patches (patch columns) linearly arranged for each color of YMCK. Then, the patch column of each color is formed adjacent to each other on the paper S. Note that, in FIG. 2, for ease of illustration, two colors (e.g., cyan (C) and black (K)) of patch columns are shown as to the toner patch image TP.

In FIG. 2, a plurality of patches in the cyan patch column is illustrated with a dotted line square, while a plurality of patches in the black patch column is illustrated with a solid line square. Then, a plurality of patches in the patch column of each color is arranged so that the toner densities thereof differ sequentially in the transport direction of the paper S, that is, so that the toner densities thereof become thinner or denser sequentially in the transport direction.

The toner patch image TP is formed in an image forming region specified for each paper S. In this example, a center portion in, for example, the width direction of the paper S (that is, the direction perpendicular to the transport direction of the paper S) is the formation region of the toner patch image TP (the formation region of the image-adjusting pattern image). However, the formation region of the toner patch image TP is not limited to the inside of the image forming region of the paper S, but can be configured to set outside the image forming region. Note that, the width direction of the paper S is also the main scanning direction in image formation, and the transport direction of the paper S is also the sub-scanning direction in image formation.

In contrast, the detection unit detecting information such as the color, density, and the like of the image-adjusting pattern image, that is, toner patch image TP, has a well-known optical toner density sensor. As described previously, the image stabilization control that reflects (feeds back) a detection result of the toner density sensor on (to) the image forming condition includes two control methods of the image stabilization control method (1) and the image stabilization control method (2).

In FIG. 1, in the image stabilization control method (1), by means of the toner density sensor 110 located on a downstream side of the secondary transfer unit 60 and installed so as to face the intermediate transfer belt 50, the toner density of an unfixed image-adjusting pattern image formed on the intermediate transfer belt 50 is detected. In the image stabilization control method (2), by means of the toner density sensor 120 installed so as to face the paper transport section after the fixing unit 80, the toner density of an image-adjusting pattern image fixed to the paper S is detected.

The toner density sensor 110 used in the image stabilization control method (1) is a photo sensor that detects, in terms of spot, the density at a certain position of an image formed on the intermediate transfer belt 50. In contrast, the toner density sensor 120 used in the image stabilization control method (2) is an optical sensor capable of detection, across the entire region in the width direction of the paper S (that is, the direction perpendicular to the transport direction of the paper S), the information about an image fixed to the paper S.

Specifically, the toner density sensor 120 includes for example: a sensor (the so-called line sensor), the pixels of which are linearly arranged across the entire region in the width direction of the paper S; a light source that irradiates an image fixed to the paper S with light; and an optical system that guides reflected light from the fixed image, based on the light emitted from this light source, to the line sensor. The line sensor may be a CCD type image sensor or may be a CMOS type (including a MOS type) image sensor.

This type of toner density sensor 120 may be referred to as an in-line sensor. The detection unit detecting the information about the toner patch image TP includes a signal processing unit processing a sensor output in the unit of pixel of the toner density sensor 120, other than the toner density sensor 120 including the line sensor, and is configured to be able to detect, not as a spot but as an area, the color information, print position information, and the like, across the entire region in the width direction of the paper S, as to an image fixed to the paper S.

Then, this detection unit is configured to be able to arbitrarily set a detection region where information about the toner patch image TP is detected in the width direction of the paper S. Specifically, for example, the detection unit selects a pixel in a specific region of the line sensor but does not select a pixel in other region, or the detection unit outputs the signal of a pixel in a specific region of the line sensor but does not output the signal of a pixel in other region, at the time of signal processing in the signal processing unit, thereby allowing a specific region to be set as a detection region.

As described above, in the image stabilization control method (2) using the toner density sensor 120 capable of detecting a fixed image across the entire region in the width direction of the paper S, more information about an image including fluctuations generated in, for example, the secondary transfer unit 60 or in the fixing unit 80, can be detected and reflected on the image forming condition. Accordingly, the image stabilization control method (2) can achieve a higher image quality than the image stabilization control method (1) that cannot detect fluctuations generated in the secondary transfer unit 60 or in the fixing unit 80.

In the image forming apparatus 1 according to the present embodiment, both the image stabilization control method (1) and the image stabilization control method (2) are adopted. However, the adoption of the image stabilization control method (1) is not indispensable. That is, the present invention can be applied to image forming apparatuses adopting at least the image stabilization control method (2).

[Regarding Image Noise]

Figure 3:
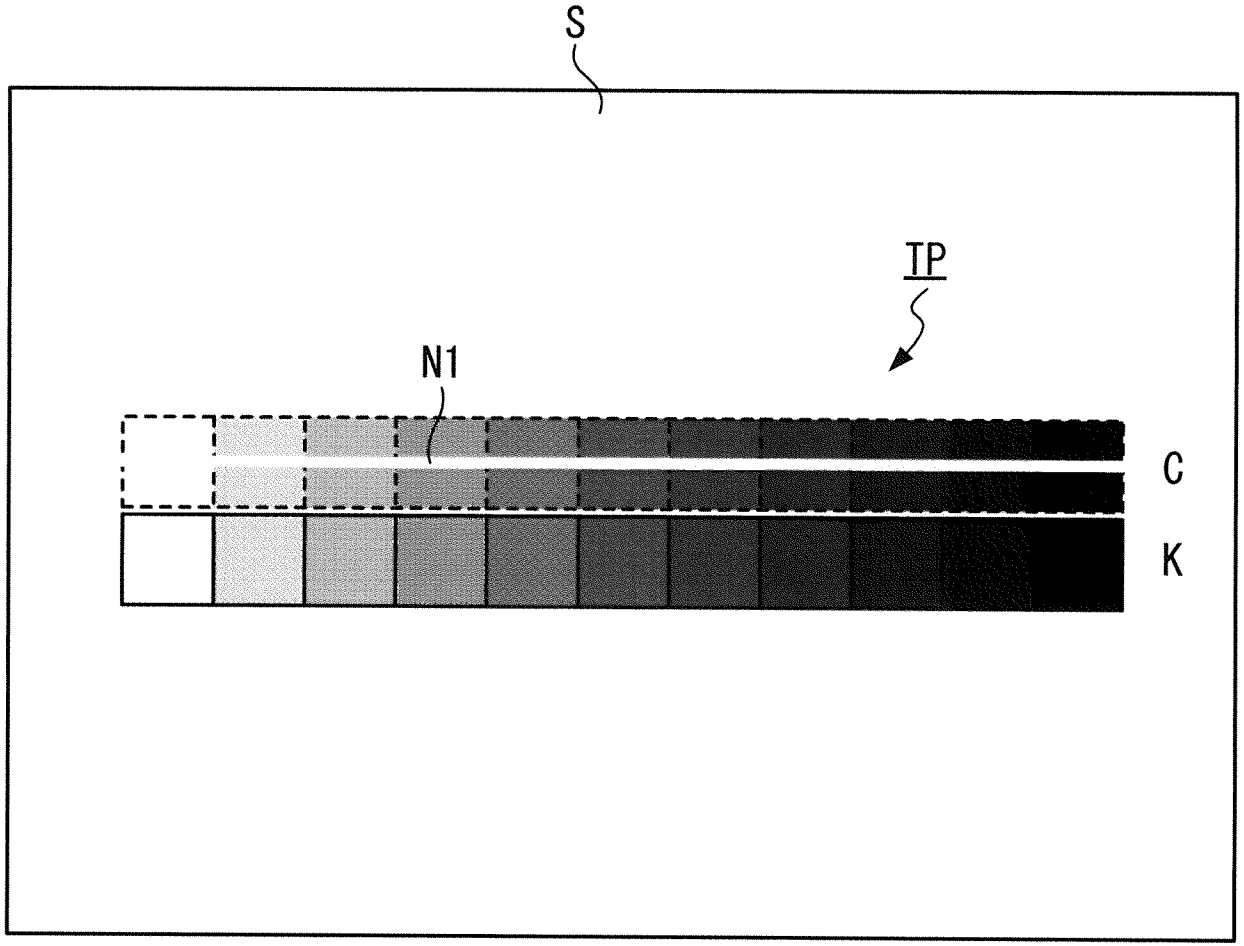
FIG. 3 is a pattern view showing a vertical streak that is an example of the image noise generated on a toner patch image.
Figure 4:
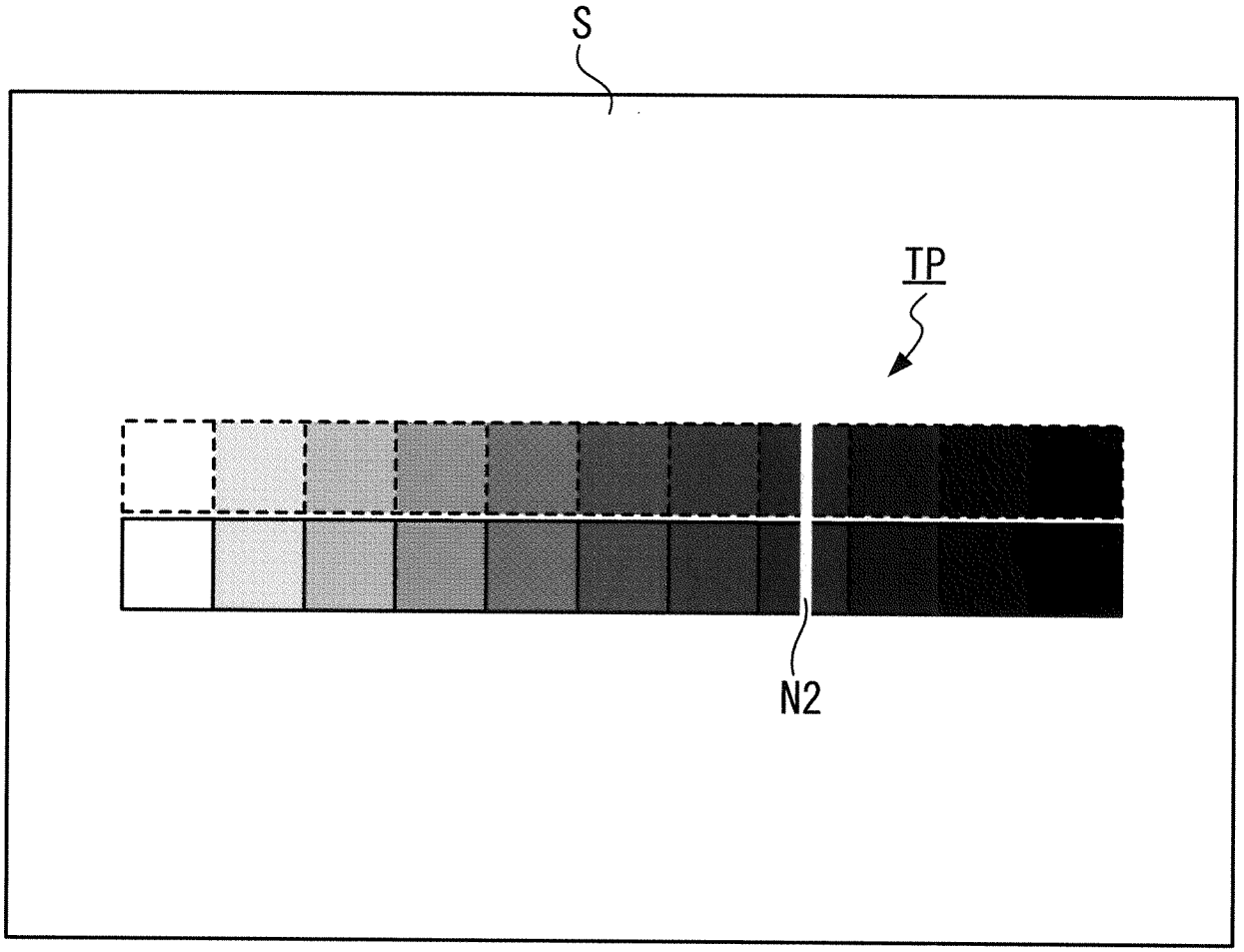
FIG. 4 is a pattern view showing a horizontal streak that is an example of the image noise generated on the toner patch image.

Incidentally, there may be image noises such as an unexpected scratch and streak, in a fixed image-adjusting pattern image, that is, in the toner patch image TP. Examples of this image noise include the so-called vertical streak N1 generated linearly along the transport direction of the paper S on the toner patch image TP as shown in FIG. 3, the so-called horizontal streak N2 generated linearly along the width direction of the paper S on the toner patch image TP as shown in FIG. 4, and the like.

The vertical streak N1 is an image noise generated by, for example, dusts adhering to the optical system of the exposure part 43 or by paper powder being caught in the cleaning part of the belt cleaning device 53. The horizontal streak N2 is an image noise generated, for example, when there is a deflection in the photoreceptor 41 or when there is a deflection in a development head of the development part 44. Note that the vertical streak N1 and the horizontal streak N2 are just examples of the image noise, and the image noise is not limited thereto.

If there is such an image noise in the fixed toner patch image TP, then under the influence of the image noise, a detection result of the toner density sensor 120 is fed back to the image forming condition, and thus the information about the toner patch image TP is not accurately reflected in the image forming condition.

Figure 5:
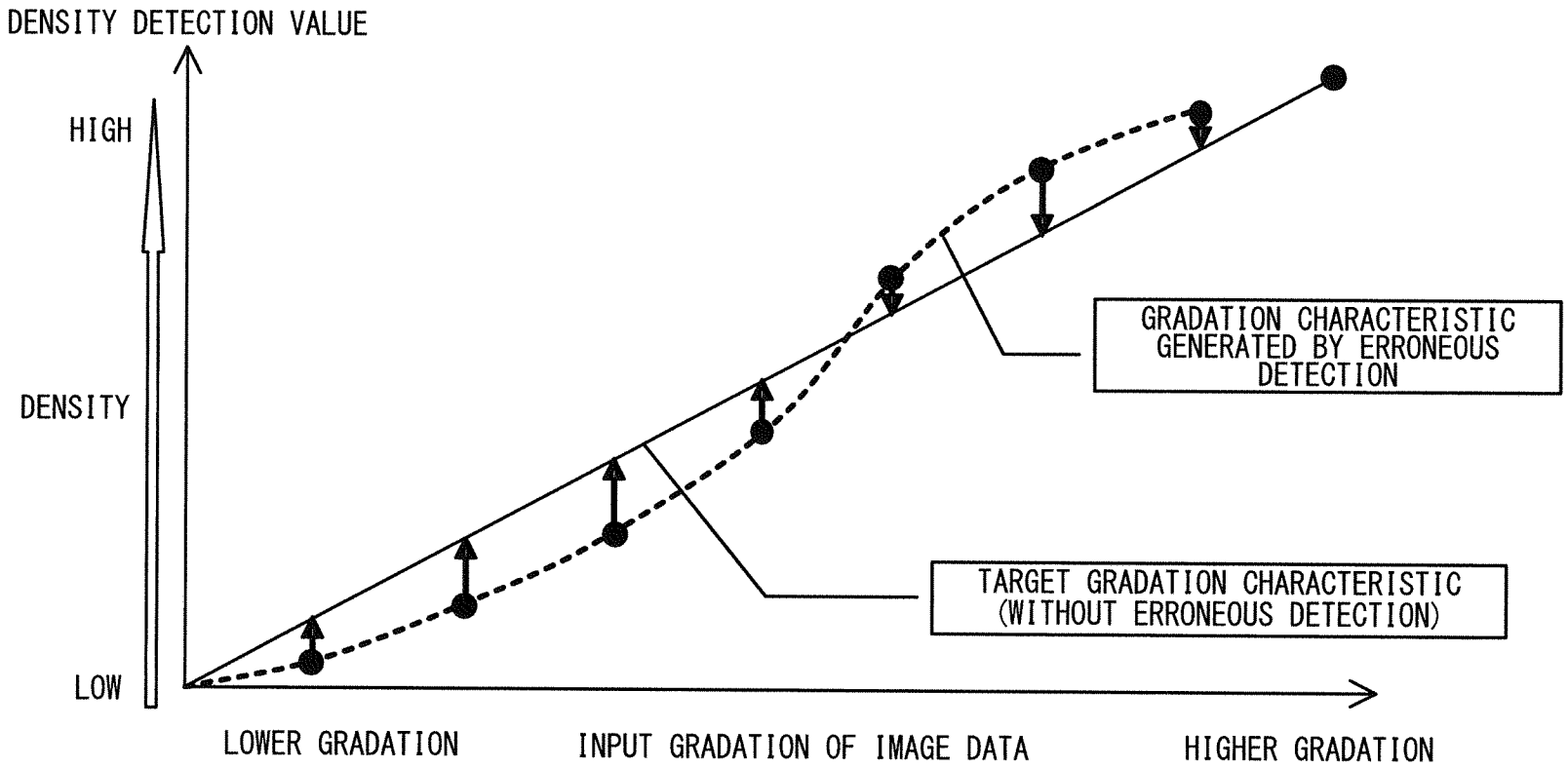
FIG. 5 is a conceptual diagram of gradation correction.

FIG. 5 is a conceptual diagram of gradation correction. In FIG. 5, the horizontal axis represents the input gradation of image data and the vertical axis represents a density detection value of the toner density sensor 120, respectively. In a state without the influence of an image noise, a target gradation characteristic indicated by a solid line in FIG. 5 is obtained. Then, a correction process of image data is carried out so as to provide a desired color, by the density detection value of the toner density sensor 120 being fed back to the image forming condition.

In contrast, if there is erroneous detection affected by an image noise, then with respect to the target gradation characteristic indicated by a solid line, as indicated by a dotted line in FIG. 5, there is obtained a gradation characteristic (a gradation characteristic produced by erroneous detection) in which the density detection value of the toner density sensor 120 shifts to a lower density side on the lower gradation side and shifts to a higher density side on the higher gradation side. Accordingly, when there is an image noise in the fixed toner patch image TP and, in a state of being under the influence thereof, a detection result of the toner density sensor 120 is fed back to the image forming condition, the correction processing of image data is not accurately performed.

Therefore, in the image forming apparatus 1 according to the present embodiment, first, prior to detection of the toner patch image TP, there is determined the presence or absence of an image noise inside the formation region of the toner patch image TP, that is, an image noise generated in the toner patch image TP.

In addition, on the basis of this determination result, a detection region where the detection unit including the toner density sensor 120 detects the toner patch image TP (hereinafter, simply referred to as the "detection region of the detection unit") is set to a region where an image noise is not generated, and on the basis of a detection result of the toner patch image TP in this set region, the image forming condition is determined. Specifically, the detection result of the detection unit of the toner patch image TP is fed back to an image forming condition and reflected on the image forming condition.

Figure 6:
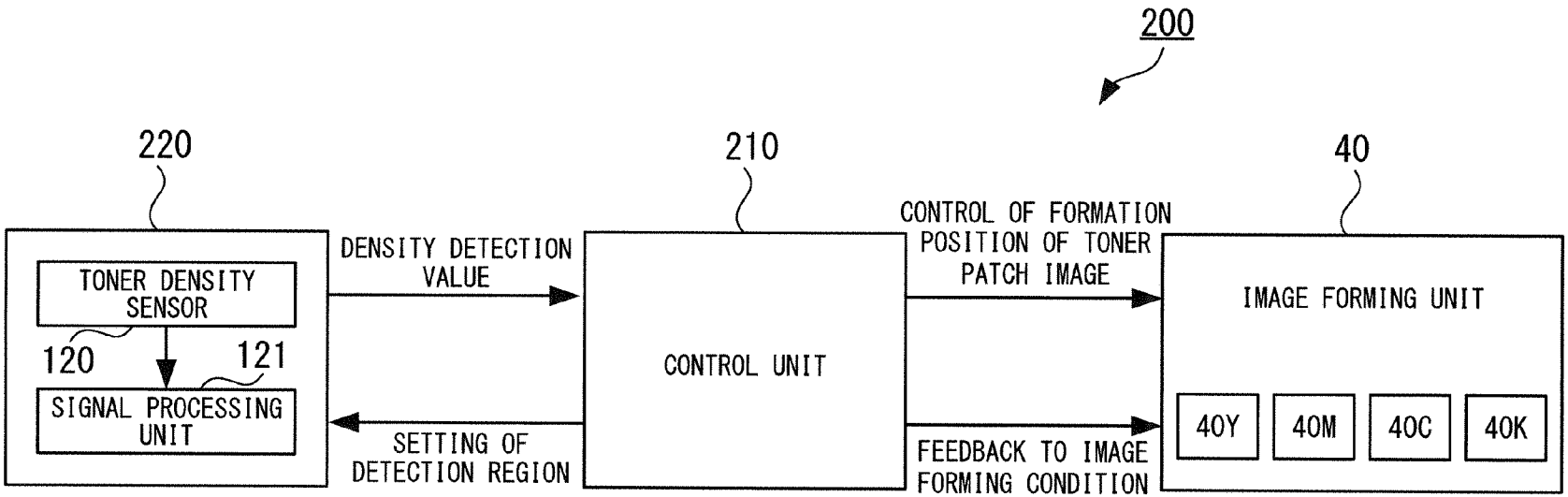
FIG. 6 is a block diagram showing an example of the configuration of a control system that performs controls such as determination of the presence or absence of an image noise, and setting of the detection region of a toner patch image.

FIG. 6 is a block diagram showing an example of the configuration of a control system that performs controls, such as the determination of the presence or absence of an image noise, and the setting of the detection region of the toner patch image TP.

As shown in FIG. 6, a control system 200 according to this example is constituted by: the image forming unit 40 including the image forming units 40Y, 40M, 40C, and 40K; a control unit 210; and a detection unit 220 including the toner density sensor 120.

The control unit 210 is also a control unit controlling the whole system of the image forming apparatus 1, and can be configured by, for example, a microcomputer. However, the control unit 210 is not limited to the configuration including a microcomputer, but can have a configuration including hardware.

In the present embodiment, the control unit 210 has a function as a determination unit determining the presence or absence of an image noise inside the formation region of the toner patch image TP, and on the basis of this determination result, the control unit 210 sets the detection region of the detection unit 220 to a region where an image noise is not generated. The control unit 210 further performs control that feeds back the detection result of the toner patch image TP in this set region, to an image forming condition.

The detection unit 220 has a signal processing unit 121 processing a sensor output in the unit of pixel of the toner density sensor 120, other than the toner density sensor 120, and can detect, in terms of area, the color information, print position information, and the like across the entire region in the width direction of the paper S, with respect to an image fixed to the paper S.

The detection unit 220 is configured to be capable of arbitrarily setting a detection region in the width direction of the paper S by, for example, selecting a pixel in a specific region of the line sensor or outputting the signal of a pixel in a specific region at the time of signal processing in the signal processing unit 121.

Figure 7:
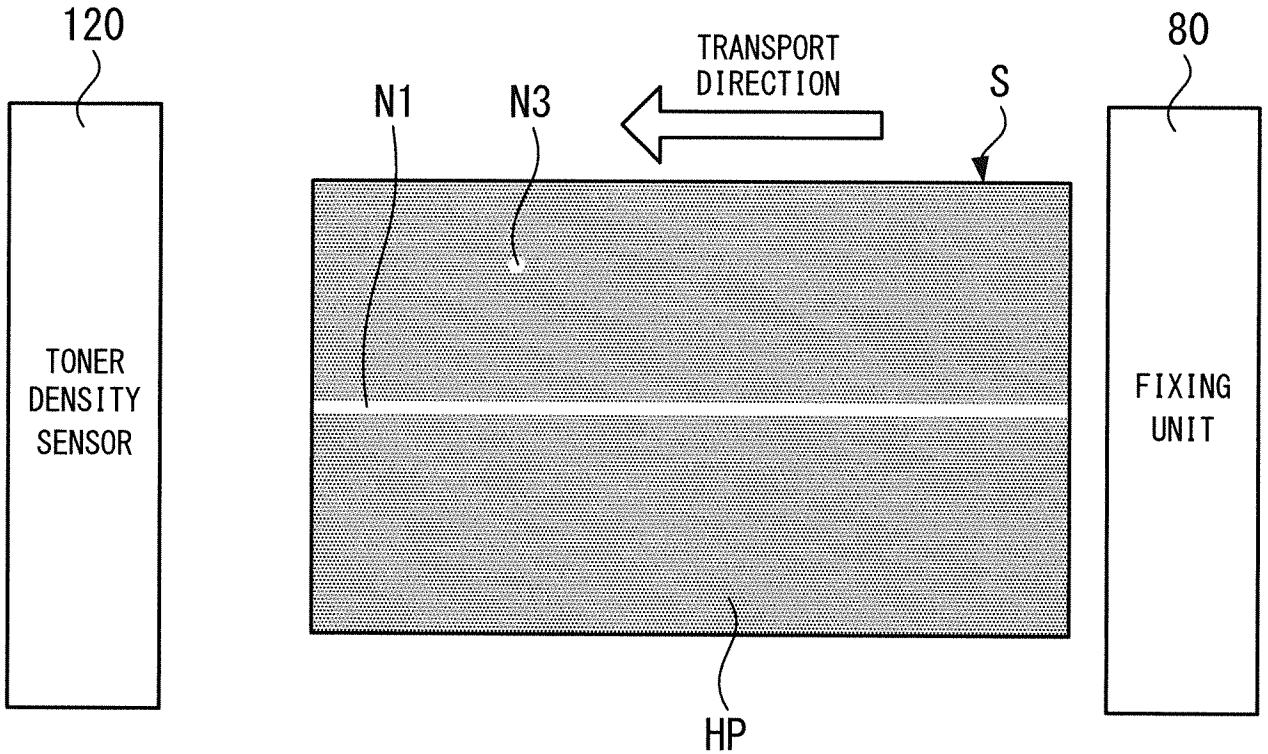
FIG. 7 is a view showing a full half-tone pattern image that is an example of an image-noise detecting pattern image.

In determining the presence or absence of an image noise inside the formation region of the toner patch image TP, an image-noise detecting pattern image is formed on the paper S, prior to forming the toner patch image TP and detecting the same. As the image-noise detecting pattern image, there can be illustrated a full half-tone pattern image HP formed across the entire surface of the paper S as shown in, for example, FIG. 7.

By forming such a full half-tone pattern image HP on the paper S, there can be understood the presence or absence of image noises such as the vertical streak N1 and a point-like noise N3, inside the image forming region, in particular, inside the formation region of the toner patch image TP, prior to forming the toner patch image TP and detecting the same. Then, the presence or absence of these image noises can be determined on the basis of the detection result of the detection unit 220 including the toner density sensor 120.

Note that, in this example, the full half-tone pattern image HP is illustrated as the image-noise detecting pattern image, but is not limiting, and the image-noise detecting pattern image may be a pattern image in which an image noise can be detected in each engine characteristic of the image forming units 40Y, 40M, 40C, and 40K in the image forming unit 40.

In determining the presence or absence of an image noise inside the formation region of the toner patch image TP, the control unit 210 can, from the detection result of the detection unit 220 based on the full half-tone pattern image HP, obtain positional information about an image noise in the width direction of the paper S and positional information in the transport direction of the paper S, other than the information about the presence or absence of an image noise and the information about the type of a noise (the shapes of the vertical streak and the horizontal streak).

Specifically, since a line sensor including pixels linearly arranged across an entire region in the width direction of the paper S is used as the toner density sensor 120, there can be detected the position of an image noise in the width direction of the paper S can be detected from the position of a pixel in which the image noise of the line sensor. Moreover, when the position of a tip in the transport direction of the paper S is set as a reference, the position of an image noise in the transport direction of the paper S can be detected from a time period taken from the reference position to the detection position of the image noise, a transportation speed of the paper S and the like.

The control unit 210 performs control that sets the detection region of the detection unit 220 including the toner density sensor 120 to a region where an image noise is not generated, on the basis of a determination result of the presence or absence of an image noise, the determination result including the positional information of the image noise. At this time, as shown in, for example, FIG. 2, in the case where a center region in the width direction of the paper S is set as a reference formation region of the toner patch image TP, the control unit 210 performs control for changing the formation region of the toner patch image TP to a region where an image noise is not generated, with respect to the image forming unit 40.

Upon completion of the controls for setting the detection region of the detection unit 220 and for changing the formation region of the toner patch image TP by the control unit 210, the formation of the toner patch image TP by the image forming unit 40 and the detection of the toner patch image TP fixed to the paper S by the detection unit 220 are carried out. At this time, because the toner patch image TP is formed in a region where an image noise is not generated and also the detection region of the detection unit 220 including the toner density sensor 120 is set, an image noise is not detected by the detection unit 220, and the detection of the toner patch image TP without an image noise is carried out. Then, the control unit 210 determines the image forming condition by reflecting the detection result of the toner patch image TP by the detection unit 220, on the image forming condition of the image forming unit 40.

As described above, by determining the presence or absence of an image noise inside the formation region of the toner patch image TP, and by setting, on the basis of this determination result, the detection region of the detection unit 220 to a region where an image noise is not generated, the detection of the toner patch image TP can be carried out in a region where an image noise is not generated. Thus, even under the conditions where an image noise is generated, the information about the toner patch image TP can be accurately reflected on the image forming condition of the image forming unit 40 to thereby determine the image forming condition, without being affected by the image noise.

Hereinafter, specific examples of the present embodiment will be described.

Example 1

Figure 8:
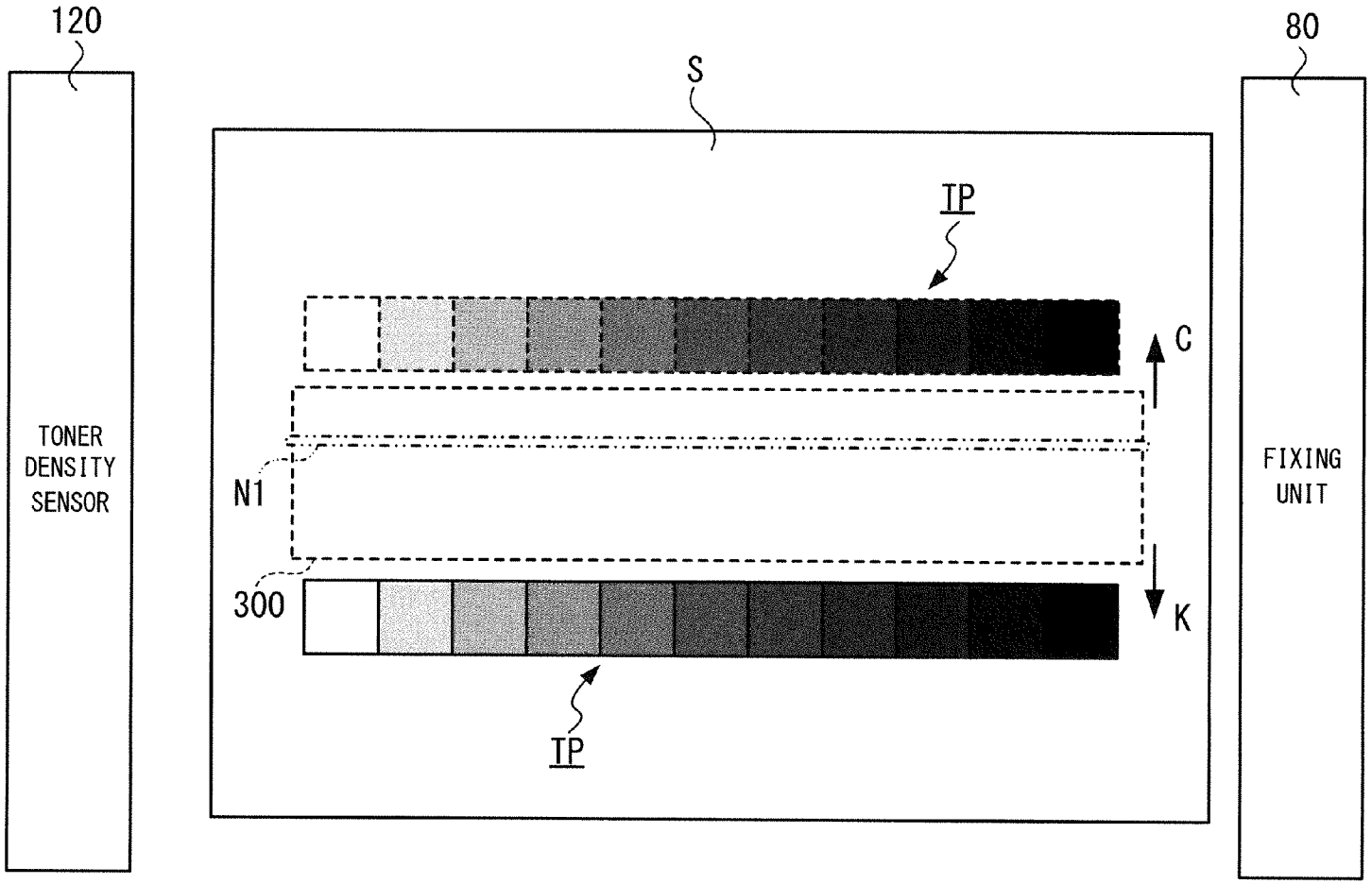
FIG. 8 is an explanatory view of Example 1.

Example 1 is an example for countermeasures particularly against the vertical streak N1 shown in FIG. 3 among image noises generated in the formation region of the toner patch image TP. Specifically, as shown in FIG. 8, in a case where a center region in the width direction of the paper S is set as a reference formation region 300 of the toner patch image TP, when it is determined that the vertical streak N1 is generated in the formation region 300, the formation position of the toner patch image TP is changed to the position in the direction perpendicular to the transport direction of the paper S.

Specifically, in a case where two colors of, for example, cyan and black of patch columns are formed as the toner patch image TP, the formation positions of both the patch columns of cyan and black are changed to positions, with intervals therebetween, in a direction perpendicular to the transport direction of the paper S. However, this is just an example, and there can also be adopted a configuration in which both the patch columns of cyan and black are shifted to either one direction without a space between both the patch columns of cyan and black. In this example, since the position where the vertical streak N1 is generated is in the cyan patch column, only the formation position of the cyan patch column may be changed without changing the formation position of the black patch column.

Figure 9:
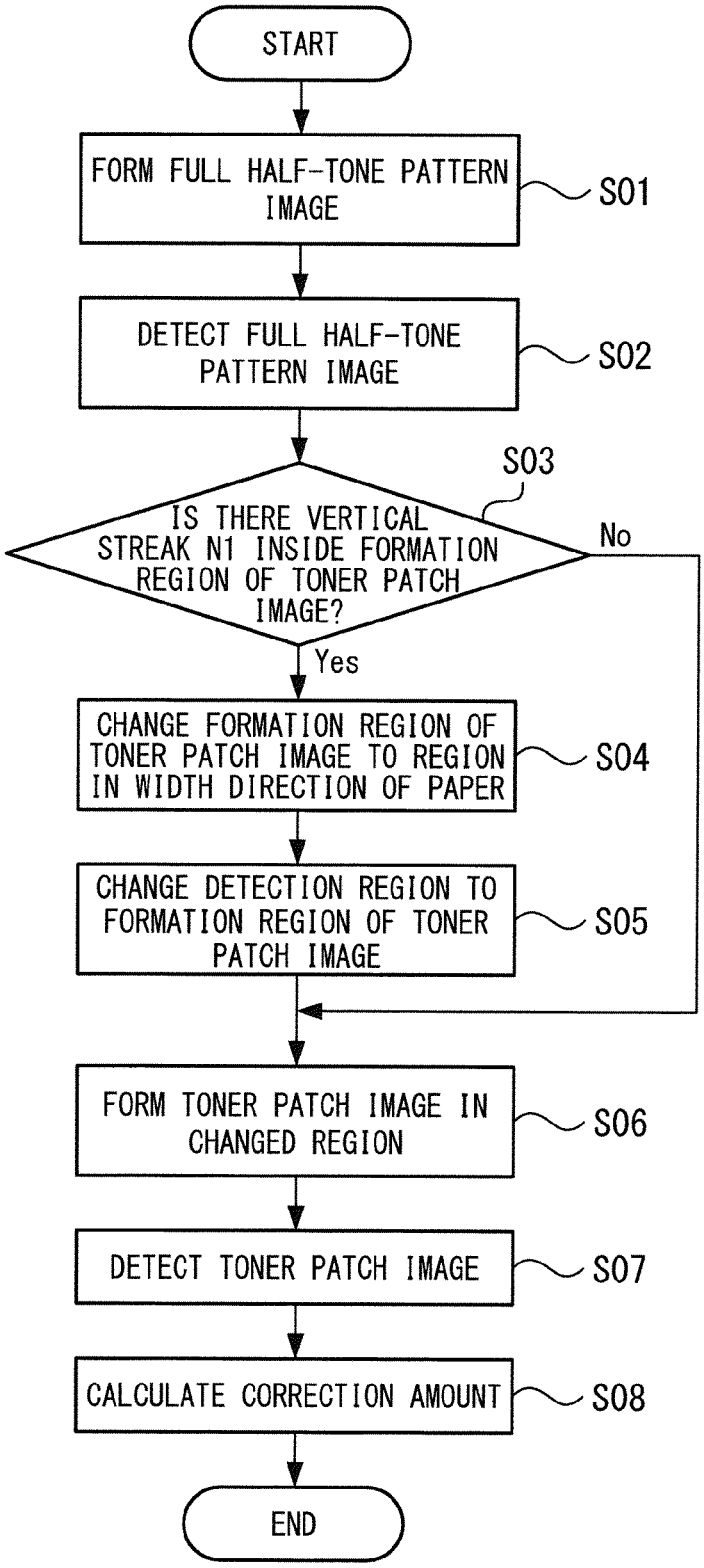
FIG. 9 is a flow chart showing a specific processing flow of Example 1.

A specific processing flow of Example 1 will be described using a flow chart of FIG. 9. This processing is carried out under the control of the control unit 210.

Prior to the formation and detection of the toner patch image TP, first the full half-tone pattern image HP (see FIG. 7) is formed as the image-noise detecting pattern image (Step S01), and then the full half-tone pattern image HP is detected by the detection unit 220 including the toner density sensor 120 (Step S02).

Subsequently, from the detection result by the detection unit 220, it is determined whether or not there is an image noise, particularly the vertical streak N1, inside the formation region 300 of the toner patch image TP that is the image-adjusting pattern image (Step S03). Here, noises with a level equal to or less than a predetermined level acceptable as a noise are not determined as image noises. Accordingly, in the processing of Step S03, it is determined with respect to the vertical streak N1 whether or not the detection level of the detection unit 220 exceeds the above-described predetermined level.

When it is determined in Step S03 (as "Yes") that there is the vertical streak N1 inside the formation region 300 of the toner patch image TP, there is performed the processing in which the formation position of the toner patch image TP is changed to the position in a direction perpendicular to the transport direction of the paper S, that is, in the width direction of the paper S (Step S04). Next, in response to the change in the formation position of the toner patch image TP in Step S04, there is performed the processing in which the detection region of the detection unit 220 is changed to the region at the formation position of the toner patch image TP (Step S05).

Next, the toner patch image TP is formed at the position changed by the processing in Step S04 (Step S06), and then the fixed toner patch image TP is detected by the detection unit 220 including the toner density sensor 120 arranged on a downstream side of the fixing unit 80 (Step S07). Next, a correction amount is calculated from a density detection value which the detection unit 220 detected, and the correction amount is fed back to the image forming condition of the image forming unit 40 (Step S08). The correction amount calculated here corresponds to a difference (in the Figure, the length of an arrow) between the target gradation characteristic indicated by a solid line in FIG. 5 and a density detection value which the detection unit 220 actually detects.

Note that, in Step S03, when it is determined (as "No") that there is no vertical streak N1 inside the formation region 300 of the toner patch image TP, the procedure moves directly to Step S06 and the toner patch image TP is formed in a reference formation region 300 (see FIG. 8).

Example 2

Figure 10:
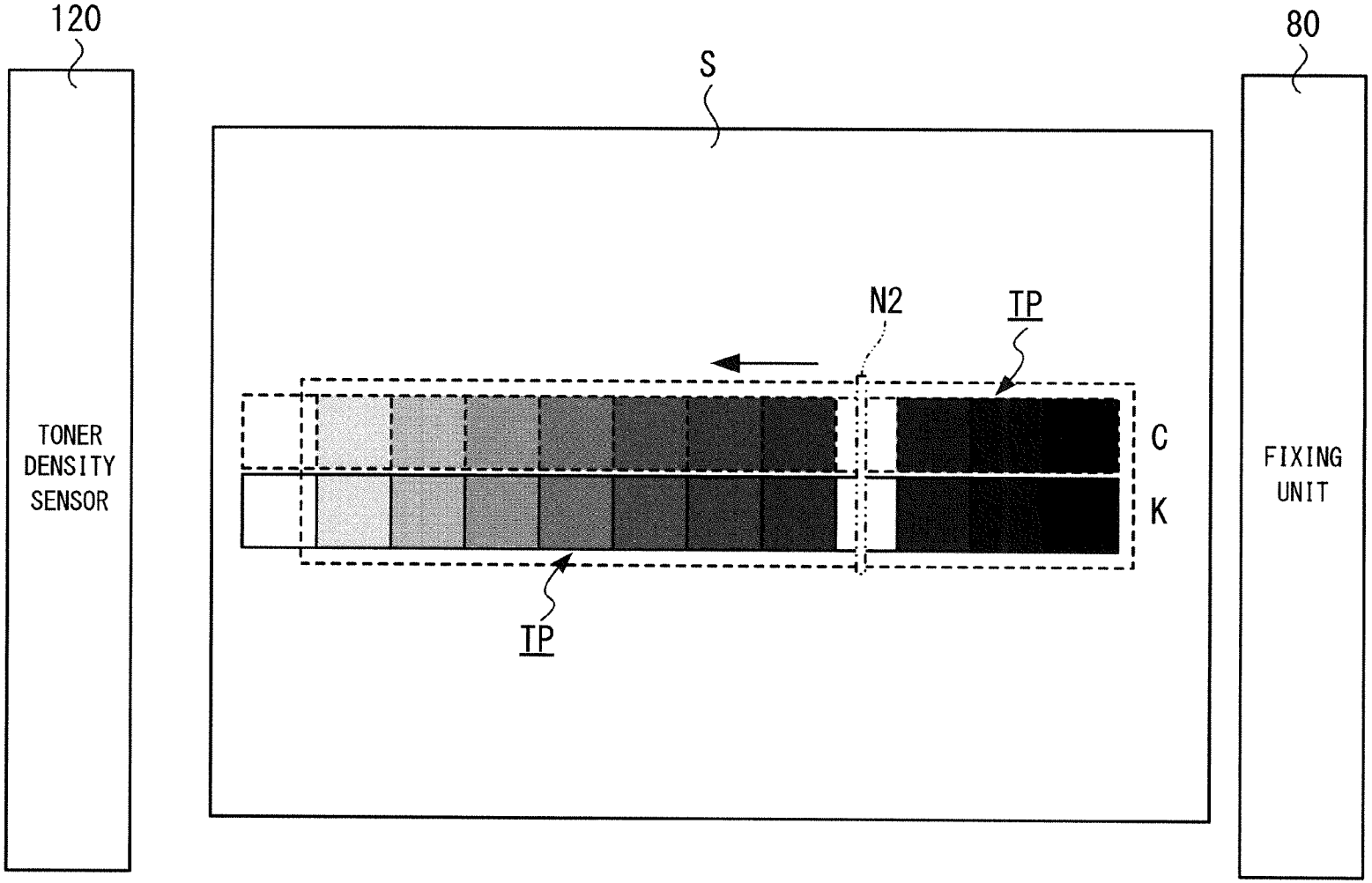
FIG. 10 is an explanatory view of Example 2.

Example 2 is an example for countermeasures against the horizontal streak N2 particularly shown in FIG. 4 among image noises generated in the formation region of the toner patch image TP. Specifically, as shown in FIG. 10, in a case where a center region in the width direction of the paper S is set as the reference formation region 300 of the toner patch image TP, when it is determined that the horizontal streak N2 is generated in the formation region 300, there is performed the processing in which the formation position of the toner patch image TP is changed to the position in the transport direction of the paper S.

Specifically, in a case where two colors (e.g., cyan and black) of patch columns are formed as the toner patch image TP, when the horizontal streak N2 is under the circumstances of being generated at the formation position of a patch with a specific toner density of both patch columns, a formation position of a patch group on a thinner toner density side is changed to the position in the transport direction of the paper S so as to avoid the formation position. The change, in the transport direction of the paper S, in the formation position of a patch group can be realized by shifting a formation timing of the patch group.

Figure 11:
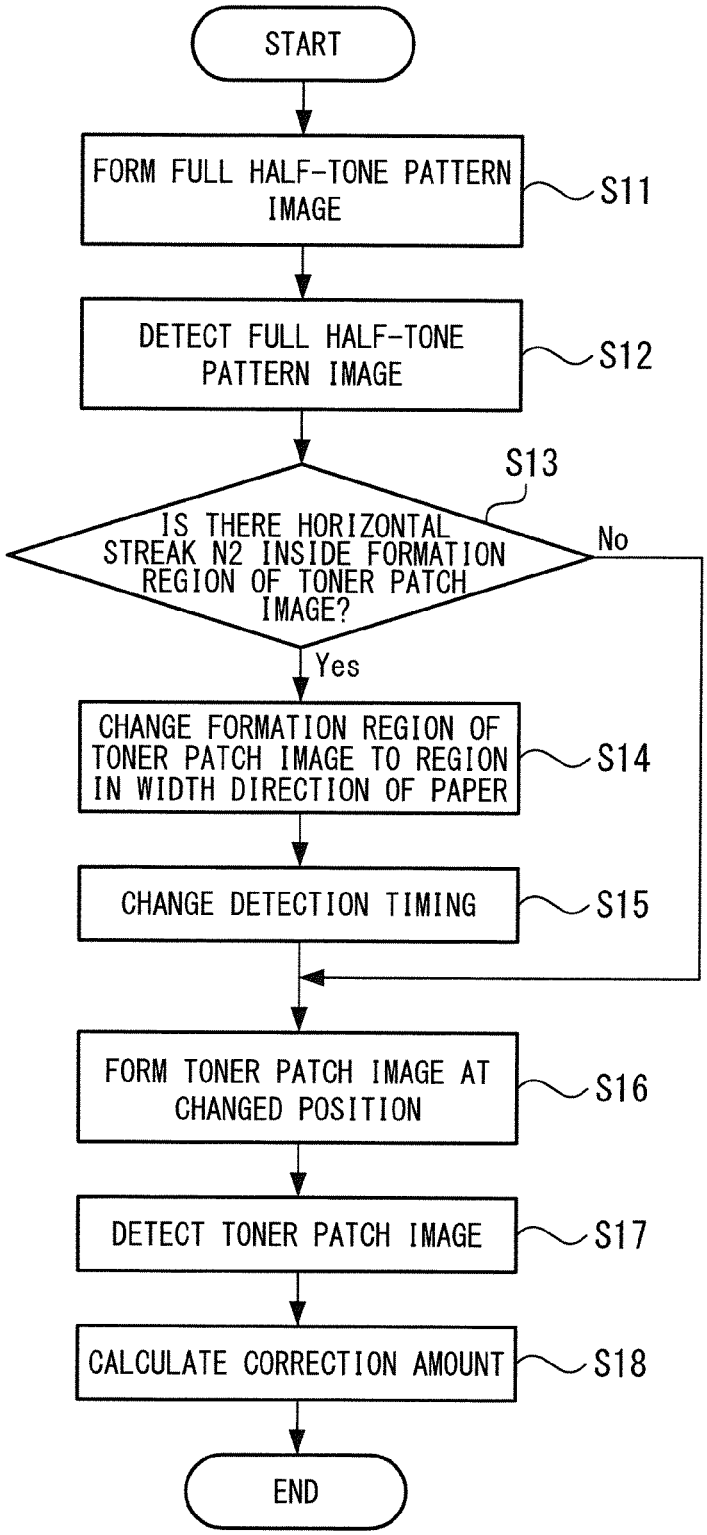
FIG. 11 is a flow chart showing a specific processing flow of Example 2.

A specific processing flow of Example 2 will be described using a flowchart of FIG. 11. This processing is carried out under the control of the control unit 210.

Prior to the formation and detection of the toner patch image TP, first, the full half-tone pattern image HP (see FIG. 7) is formed as the image-noise detecting pattern image (Step S11), and then the full half-tone pattern image HP is detected by the detection unit 220 including the toner density sensor 120 (Step S12).

Subsequently, from the detection result by the detection unit 220, it is determined whether or not there is an image noise, particularly the horizontal streak N2, inside the formation region 300 of the toner patch image TP (Step S13). Here, noises with a level equal to or less than a predetermined level acceptable as a noise are not determined as image noises. Accordingly, in the processing of Step S13, it is determined with respect to the horizontal streak N2 whether or not the detection level of the detection unit 220 exceeds the above-described predetermined level.

When it is determined in Step S13 (as "Yes") that there is the horizontal streak N2 inside the formation region 300 of the toner patch image TP, the formation position of the toner patch image TP is changed to the position in the transport direction of the paper S (Step S14). Next, in response to the change of the formation position of the toner patch image TP in Step S14, a detection timing of the detection unit 220 is changed to the timing at the formation position of the toner patch image TP (Step S15).

Next, by changing the formation timing of the toner patch image TP, the toner patch image TP is formed at the position changed by the processing in Step S14 (Step S16). Next, by means of the detection unit 220 including the toner density sensor 120, the fixed toner patch image TP is detected at the detection timing changed by the processing in Step S15 (Step S17). Next, a correction amount is calculated from the density detection value which the detection unit 220 detected, and the correction amount is fed back to the image forming condition of the image forming unit 40 (Step S18). The correction amount calculated here corresponds to a difference (in the view, the length of an arrow) between the target gradation characteristic indicated by a solid line in FIG. 5 and a density detection value which the detection unit 220 actually detects.

Note that, when it is determined in Step S13 (as "No") that there is no horizontal streak N2 inside the formation region 300 of the toner patch image TP, the procedure moves directly to Step S16 and the toner patch image TP including a continuous patch column (see FIG. 2) is formed.

Example 3

In Examples 1 and 2, the formation region 300 serving as the reference of the toner patch image TP is defined, and the formation position of the toner patch image TP and the detection region or detection timing of the detection unit 220 are set in accordance with the type of an image noise.

Figure 12:
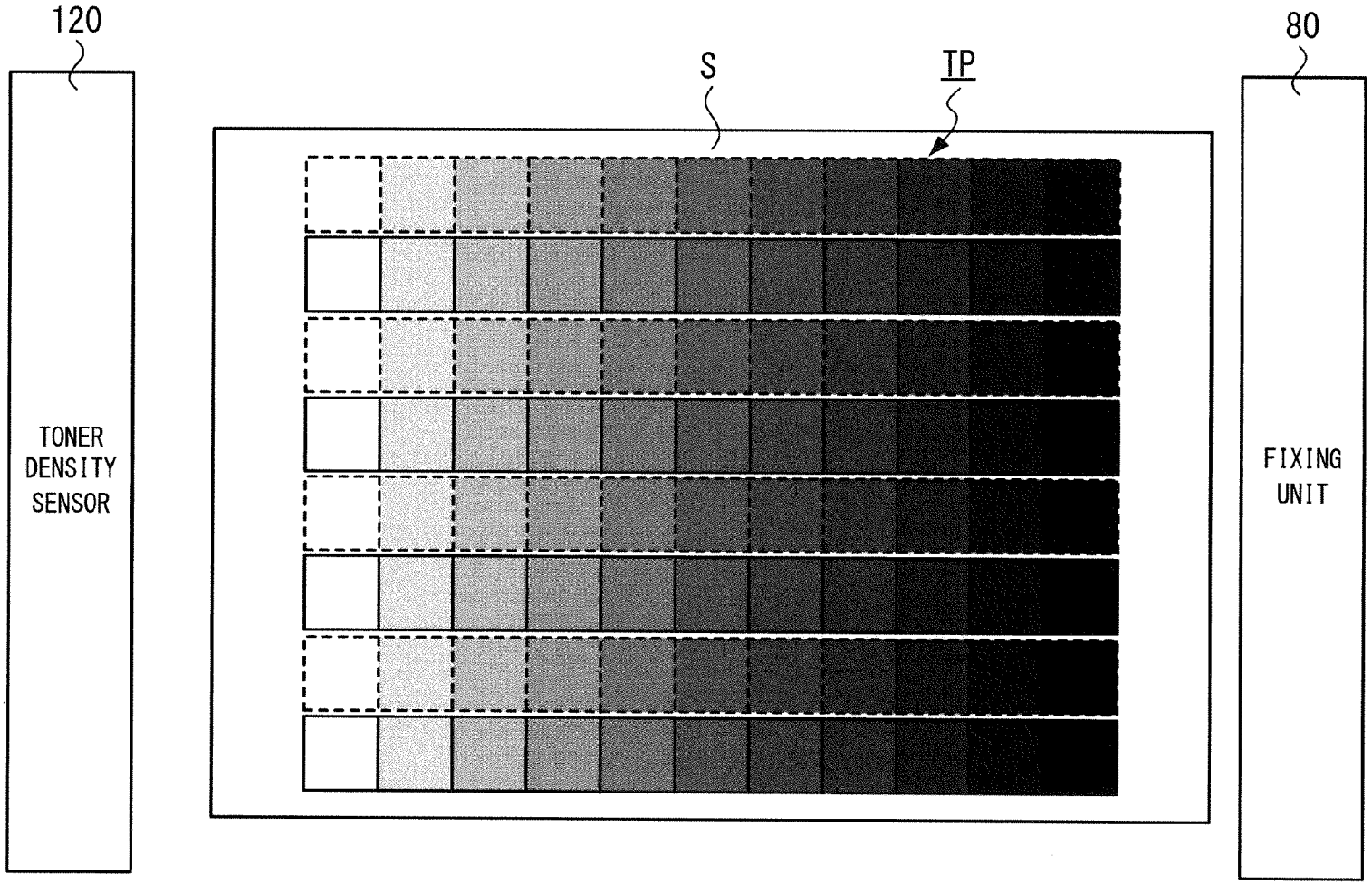
FIG. 12 is an explanatory view of Example 3.

In contrast, in Example 3, as shown in FIG. 12, there is adopted a configuration in which the toner patch image TP that is the image-adjusting pattern image is formed across the entire surface of the paper S, while only the detection region of the detection unit 220 including the toner density sensor 120 is set to a region where an image noise is not generated. Although the adoption of this configuration increases the consumption of toner, there are advantages that, even if an image noise is found, the processing of changing the formation position of the toner patch image TP becomes unnecessary, and also that, regardless of the type of an image noise, control that reflects the detection result of the toner patch image TP, on an image forming condition can be performed.

Figure 13:
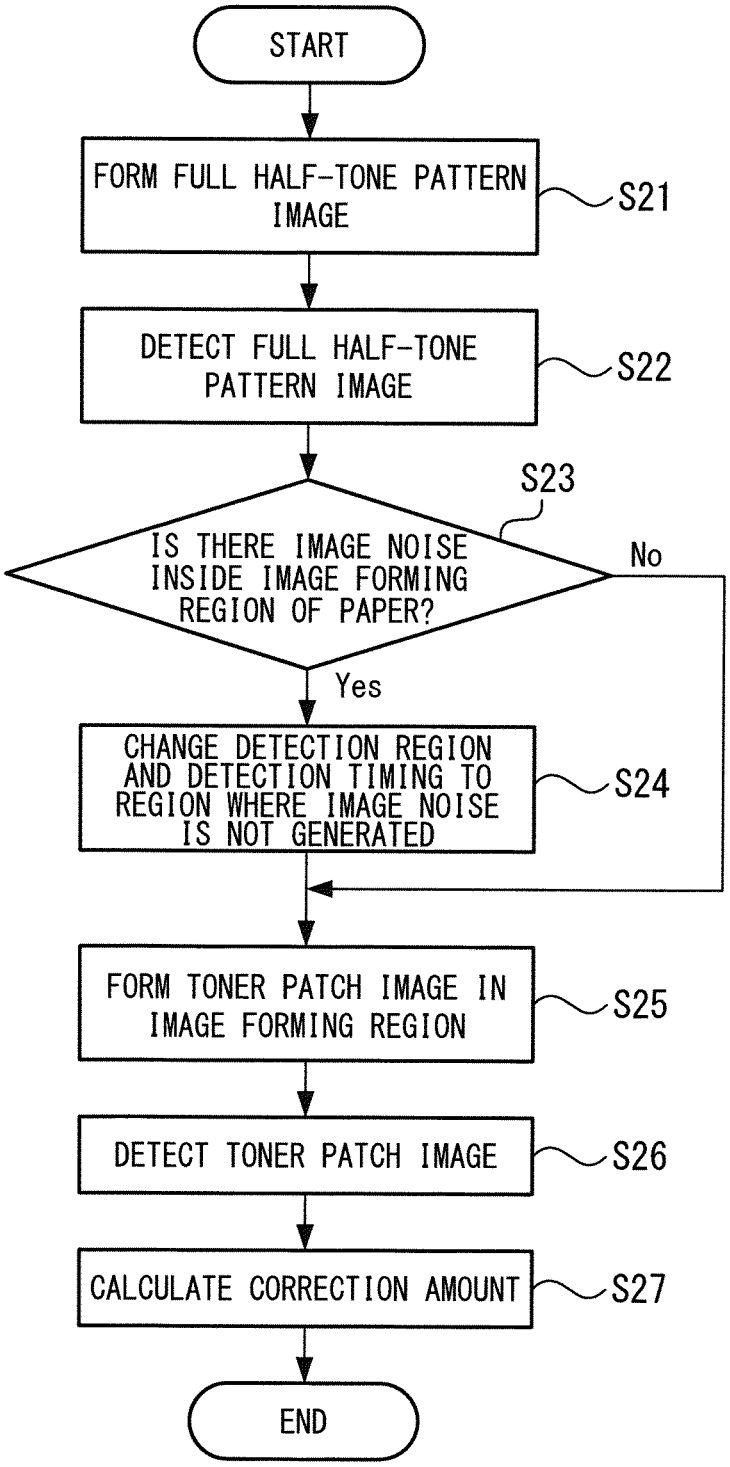
FIG. 13 is a flow chart showing a specific processing flow of Example 3.

A specific processing flow of Example 3 will be described using a flowchart of FIG. 13. This processing is carried out under the control of the control unit 210.

Prior to the formation and detection of the toner patch image TP, first, the full half-tone pattern image HP (see FIG. 7) is formed as the image-noise detecting pattern image (Step S21), and then the full half-tone pattern image HP is detected by the detection unit 220 including the toner density sensor 120 (Step S22).

Next, from the detection result by the detection unit 220, it is determined whether or not there is an image noise inside the image forming region of the paper S (Step S23). Here, noises with a level equal to or less than a predetermined level acceptable as a noise are not determined as image noises. Accordingly, in the processing of Step S23, it is determined whether or not the detection level of the detection unit 220 exceeds the above-described predetermined level. Furthermore, in the determination process of Step S23, regardless of the type, shape, and the like of a noise, the determination of the presence or absence of every image noise is carried out.

When it is determined in Step S23 (as "Yes") that there is an image noise inside the image forming region of the paper S, there is performed the processing in which the detection region and detection timing of the detection unit 220 are changed to a region where an image noise is not generated (Step S24). Subsequently, the toner patch image TP is formed across the entire surface of the paper S (Step S25).

Subsequently, by means of the detection unit 220 including the toner density sensor 120, the fixed toner patch image TP is detected in the detection region or at the detection timing changed by the processing in Step S24 (Step S26). Subsequently, a correction amount is calculated from a density detection value which the detection unit 220 detected, and the correction amount is fed back to the image forming condition of the image forming unit 40 (Step S27). The correction amount calculated here corresponds to a difference (in the figure, the length of an arrow) between the target gradation characteristic indicated by a solid line in FIG. 5 and a density detection value which the detection unit 220 actually detects.

When it is determined in Step S23 (as "No") that there is no image noise inside the image forming region of the paper S, the procedure moves directly to Step S25, and the toner patch image TP is formed, inside the image forming region of the paper S, that is, across the entire surface of the paper S in this example.

Note that, in the above-described embodiment, a case where the present invention is applied to a copying machine as the image forming apparatus 1 has been described as an example, but not limited to this application example. That is, the present invention can be applied to electrophotographic image forming apparatuses in general, such as a printer apparatus, a facsimile apparatus, a printing machine, and a complex machine, which form an image using static electricity. Moreover, the present invention can be also applied to the so-called production printing machine that is provided with a paper feed unit as a separate unit and that is capable of forming an image at high speed.

What is claimed is:

1. An image forming apparatus that determines an image forming condition by using an image-adjusting pattern image, the apparatus comprising:

a detection unit detecting information about the image-adjusting pattern image fixed to a paper;

a determination unit which, on the basis of an image-noise detecting pattern image that is formed on the paper prior to forming the image-adjusting pattern image, determines the presence or absence of an image noise generated in the image-adjusting pattern image; and a control unit which, on the basis of a determination result of the determination unit, sets a detection region where the detection unit detects information about the image-adjusting pattern image, to a region where the image noise is not generated, and which further determines the image forming condition by using the information detected in the detection region.

2. The image forming apparatus according to claim 1, wherein the detection unit includes a sensor having therein pixels linearly arranged across an entire region in a direction perpendicular to a transport direction of the paper.

3. The image forming apparatus according to claim 1, wherein the image-noise detecting pattern image is formed across an entire surface of the paper.

4. The image forming apparatus according to claim 1, wherein the control unit changes a formation position of the image-adjusting pattern image from a formation region serving as a reference to a region in a direction perpendicular to the transport direction of the paper, and changes, corresponding to the changed formation position, a detection region of the detection unit.

5. The image forming apparatus according to claim 1, wherein the control unit changes a formation position of the image-adjusting pattern image from a formation region serving as a reference to a region in the transport direction of the paper, and changes, corresponding to the changed formation position, a detection timing of the detection unit.

6. The image forming apparatus according to claim 4, wherein the image-adjusting pattern image is formed across an entire surface of the paper.

7. An image forming method of determining an image forming condition by using an image-adjusting pattern image, the method comprising:

a determination step of determining, on the basis of an image-noise detecting pattern image formed in a paper, the presence or absence of an image noise generated in the image-adjusting pattern image;

a region setting step of setting, on the basis of a determination result of the determination step, a region where the image noise is not generated, as a detection region where information about the image-adjusting pattern image is detected;

a detection step of detecting information about the image-adjusting pattern image fixed to the detection region on the paper; and a condition determination step of determining the image forming condition by using the information detected in the detection step.

8. The image forming method according to claim 7, wherein the detection step is carried out using a sensor having therein pixels linearly arranged across an entire region in a direction perpendicular to a transport direction of the paper.

9. The image forming method according to claim 7, wherein the image-noise detecting pattern image is formed across an entire surface of the paper.

10. The image forming method according to claim 7, wherein the region setting step changes a formation position of the image-adjusting pattern image from a formation region serving as a reference to a region in a direction perpendicular to the transport direction of the paper, and changes, corresponding to the changed formation position, a detection region where information about the image-adjusting pattern image is detected.

11. The image forming method according to claim 7, wherein the region setting step changes a formation position of the image-adjusting pattern image from a formation region serving as a reference to a region in the transport direction of the paper, and changes, corresponding to the changed formation position, a detection timing in the detection step.

12. The image forming method according to claim 10, wherein the image-adjusting pattern image is formed across an entire surface of the paper.

* * * * *